US010799413B1

(12) United States Patent
Kachkovsky et al.

(10) Patent No.: US 10,799,413 B1
(45) Date of Patent: Oct. 13, 2020

(54) THERAPEUTIC SESSION RESTRAINT CHAIR

(71) Applicant: PRIDE Enterprises, Brandon, FL (US)

(72) Inventors: Oliver Kachkovsky, Jacksonville, FL (US); Neil Kreitman, Floral City, FL (US); Janice Jackson, Gainesville, FL (US)

(73) Assignee: PRIDE ENTERPRISES, Brandon, FL (US)

( * ) Notice: Subject to any disclaimer, the term of this patent is extended or adjusted under 35 U.S.C. 154(b) by 92 days.

(21) Appl. No.: 16/285,319

(22) Filed: Feb. 26, 2019

Related U.S. Application Data

(60) Provisional application No. 62/649,037, filed on Mar. 28, 2018.

(51) Int. Cl.
*A61G 15/10* (2006.01)
*E05B 67/38* (2006.01)
*A61G 15/00* (2006.01)

(52) U.S. Cl.
CPC ..... *A61G 15/10* (2013.01); *A61G 15/007* (2013.01); *E05B 67/383* (2013.01)

(58) Field of Classification Search
CPC ..... A61G 15/10; A61G 15/00; A61G 15/007; A61G 15/105; A61G 2203/70; A61F 5/3761; A61F 5/3769; A61F 5/3792; A47C 15/004
USPC ..... 297/172, 170, 135, 464, 466, 487
See application file for complete search history.

(56) References Cited

U.S. PATENT DOCUMENTS 4,930,842 A * 6/1990 Wilkinson ..... A61F 5/3792 297/310
5,758,892 A * 6/1998 Hogan ..... A61F 5/3776 280/250.1
2013/0106146 A1* 5/2013 Leclaire ..... E05B 75/00 297/135
2013/0328374 A1* 12/2013 Priest ..... A47C 15/004 297/411.2

FOREIGN PATENT DOCUMENTS

CN 208597941 * 3/2019

OTHER PUBLICATIONS

Machine Translation of CN 208597941 from Espacenet (Year: 2019).*

* cited by examiner

*Primary Examiner* — Mark R Wendell
(74) *Attorney, Agent, or Firm* — Nixon & Vanderhye P.C.

(57) ABSTRACT

A restraint chair includes a supporting frame with a seat and a desk. A wrist capture bar is associated with the desk and is displaceable between a retracted position and an extended position. An ankle capture bar is associated with the desk pedestal and is displaceable between a disengaged position and an engaged position. Control levers positioned behind the seat are coupled with the wrist capture bar and the ankle capture bar via a link assembly. Translation of the control levers effects respective displacement of the wrist capture bar between the retracted position and the extended position and of the ankle capture bar between the disengaged position and the engaged position.

17 Claims, 7 Drawing Sheets

THERAPEUTIC SESSION RESTRAINT CHAIR

CROSS-REFERENCES TO RELATED APPLICATIONS

This application claims the benefit of U.S. Provisional Patent Application No. 62/649,037, filed Mar. 28, 2018, the entire content of which is herein incorporated by reference.

STATEMENT REGARDING FEDERALLY SPONSORED RESEARCH OR DEVELOPMENT (NOT APPLICABLE)

BACKGROUND

The invention relates to a therapeutic session restraint chair and, more particularly, to a chair incorporating a restraining assembly constructed primarily to function within the specific requirements and limitations consistent with securing potentially disruptive inmates in a therapeutic group environment.

In an environment with potentially disruptive inmates, it is sometimes desirable to physically restrain the inmates to limit disruptive behavior.

BRIEF SUMMARY

The invention referenced herein relates to a restraining assembly constructed primarily to function within the specific requirements and limitations consistent with securing potentially disruptive inmates (clients) in a therapeutic group environment. The device includes a pedestal-mounted seat and a pedestal-mounted desk, both supported by a floor level horizontal frame. Staff personnel operate from behind the seat with controls that afford the option of securing either the hands or the feet, or both, of clients present for a therapeutic or recreation session. The controls, hand and foot, extend one or both of two drive rods into their respective receiving sockets, affecting a secure barrier sufficient to limit movement of shackled extremities no farther than the length of chain or cable that connects the restraint devices.

In an exemplary embodiment, a restraint chair includes a supporting frame supporting a seat secured to a seat pedestal and a desk secured to a desk pedestal. A wrist capture bar associated with the desk is displaceable between a retracted position and an extended position, and an ankle capture bar associated with the desk pedestal is displaceable between a disengaged position and an engaged position. Control levers positioned behind the seat are coupled with the wrist capture bar and the ankle capture bar via a link assembly. Translation of the control levers effects respective displacement of the wrist capture bar between the retracted position and the extended position and of the ankle capture bar between the disengaged position and the engaged position.

The desk may include a notch in a side thereof facing the seat, and the wrist capture bar may span across the notch in the extended position. The chair may further include a bar housing secured to the supporting frame, where the ankle capture bar is disposed in the bar housing. The desk pedestal may include a socket therein positioned facing the bar housing, where the ankle capture bar extends from the bar housing into the socket in the desk pedestal in the engaged position.

The chair may include four control levers including a first hand-operated lever, a second hand-operated lever, a first foot-operated lever, and a second foot-operated lever. Translation of the first hand-operated lever and/or translation of the first foot-operated lever may effect displacement of the wrist capture bar, and translation of the second hand-operated lever and/or translation of the second foot-operated lever may effect displacement of the ankle capture bar.

The first hand-operated lever and the second hand-operated lever may include respective hasps that may be configured for receiving a lock when the first hand-operated lever and the second hand-operated lever are positioned with the wrist capture bar in the extended position and with the ankle capture bar in the engaged position.

The linkage assembly may include a wrist bar linkage assembly. The wrist bar linkage assembly may include a first hand-operated linkage cam connected to the first hand-operated lever, where the first hand-operated linkage cam is rotatable with rotation of the first hand-operated lever. A first hand-operated linkage may be connected at one end to the first hand-operated linkage cam, where the first hand-operated linkage cam may convert rotation of the first hand-operated lever and the first hand-operated linkage into linear displacement of the first hand-operated linkage. A wrist bar coupling may be connected to an opposite end of the first hand-operated linkage. A first foot-operated linkage cam may be connected to the first foot-operated lever, where displacement of the first foot-operated lever may effect rotation of the first foot-operated linkage cam. A first foot-operated linkage may be connected at one end to the first foot-operated linkage cam, where the first foot-operated linkage cam may convert displacement of the first foot-operated lever and the first foot-operated linkage into linear displacement of the first foot-operated linkage, and where an opposite end of the first foot-operated linkage is connected to the wrist bar coupling. A horizontal linkage shaft may be connected to and linearly displaceable with the wrist bar coupling. A vertical linkage may be rotatably secured to the supporting frame on a first rotating axis, where the vertical linkage may be connected to the horizontal linkage shaft offset from the first rotating axis such that displacement of the horizontal linkage shaft effects rotation of the vertical linkage. A vertical linkage shaft may be connected to and rotatable with the vertical linkage. A desk level linkage cam may be connected to and rotatable with the vertical linkage shaft, and a desk level coupling may be connected at one end to the desk level linkage cam. A desk level linkage shaft may be connected to an opposite end of the desk level coupling, where the desk level coupling may convert rotation of the desk level linkage cam into linear displacement of the desk level linkage shaft. Finally, the desk level linkage shaft may be connected to the wrist capture bar.

The wrist bar linkage assembly may further include a vertical linkage cam connected between the horizontal linkage shaft and the vertical linkage. The wrist bar linkage assembly may further include a desk level linkage connected between the desk level linkage shaft and the wrist capture bar.

The linkage assembly may also include an ankle bar linkage assembly. The ankle bar linkage assembly may include a hand-operated actuating shaft connected to the second hand-operated lever, where the hand-operated actuating shaft may be rotatable with rotation of the second hand-operated lever. A second hand-operated linkage cam may be connected to the hand-operated actuating shaft, where the second hand-operated linkage cam may be rotatable with the hand-operated actuating shaft on a second rotating axis. A second hand-operated linkage may be connected at one end to the second hand-operated linkage cam at a position spaced from the second rotating axis, where the second hand-operated linkage cam may convert displacement of the second hand-operated lever and the hand-operated actuating shaft into linear displacement of the second hand-operated linkage. An ankle bar coupling may be connected to an opposite end of the second hand-operated linkage. A second foot-operated actuating shaft may be connected to the second foot-operated lever, where the second foot-operated actuating shaft may be rotatable with displacement of the second foot-operated lever. A second foot-operated linkage cam may be connected at one end to and rotatable with the second foot-operated actuating shaft. A second foot-operated linkage may be connected to an opposite end of the second foot-operated linkage cam, where the second foot-operated linkage cam may convert rotation of the second foot-operated actuating shaft into linear displacement of the second foot-operated linkage, and where the second foot-operated linkage is connected to the ankle bar coupling. The ankle capture bar may be connected to the ankle bar coupling and may be linearly displaceable with the ankle bar coupling.

The ankle bar linkage assembly may further include a supporting guide shaft fixed to the supporting frame, and the ankle bar coupling may be supported by and displaceable on the supporting guide shaft.

The control levers may be translatable to effect simultaneous displacement of the wrist capture bar and the ankle capture bar. The control levers may be translatable independently to effect independent displacement of the wrist capture bar and the ankle capture bar. The control levers may be configured to be locked with the wrist capture bar in the extended position and with the ankle capture bar in the engaged position. In this context, at least two of the control levers may include hasps.

In another exemplary embodiment, a restraint chair includes a supporting frame, a seat secured to a seat pedestal fixed to the supporting frame, and a desk secured to a desk pedestal fixed to the supporting frame. A wrist capture bar associated with the desk is displaceable between a retracted position and an extended position, and an ankle capture bar associated with the desk pedestal is displaceable between a disengaged position and an engaged position. Four control levers are positioned behind the seat, where a first two of the four control levers are coupled with the wrist capture bar via a wrist bar linkage assembly, and a second two of the four control levers are coupled with the ankle capture bar via an ankle bar linkage assembly. Displacement of either or both of the first two control levers effects displacement of the wrist capture bar, and displacement of either of both of the second two control levers effects displacement of the ankle capture bar.

BRIEF DESCRIPTION OF THE DRAWINGS

These and other aspects and advantages will be described in detail with reference to the accompanying drawings, in which.

DETAILED DESCRIPTION

Figure 1:
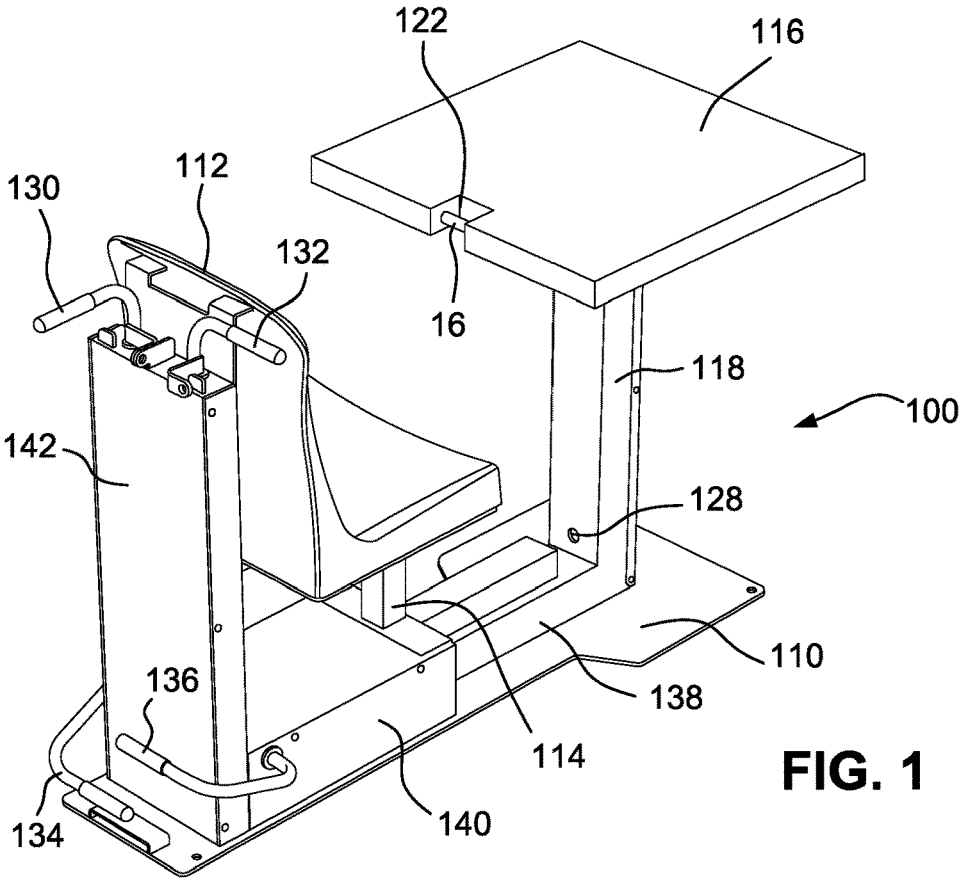
FIG. 1 is a rear perspective view of the therapeutic restraint chair with the lever position set for closed wrist capture bar/open ankle capture bar.
Figure 2:
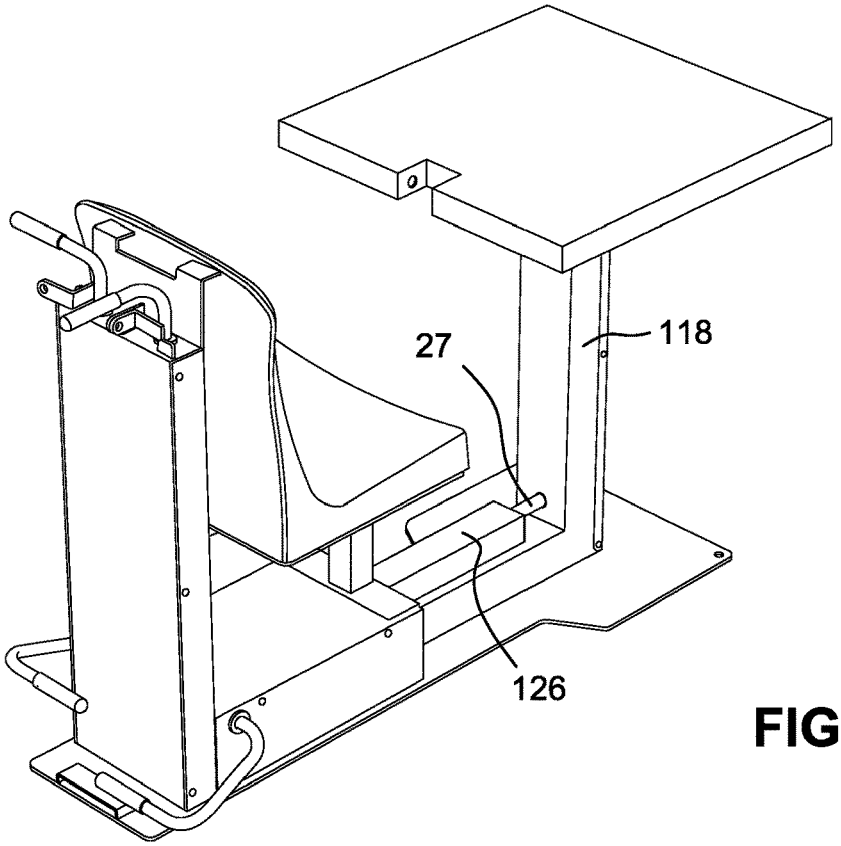
FIG. 2 is a rear perspective view with the lever position set for open wrist capture bar/closed ankle capture bar.
Figure 3:
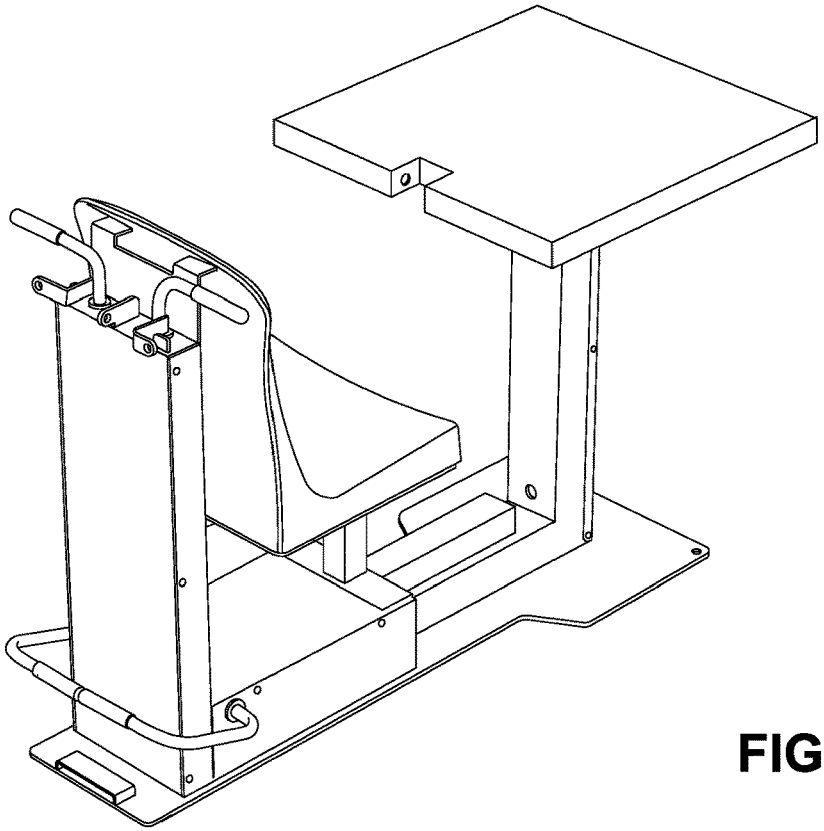
FIG. 3 shows both bars in an unlocked position.
Figure 4:
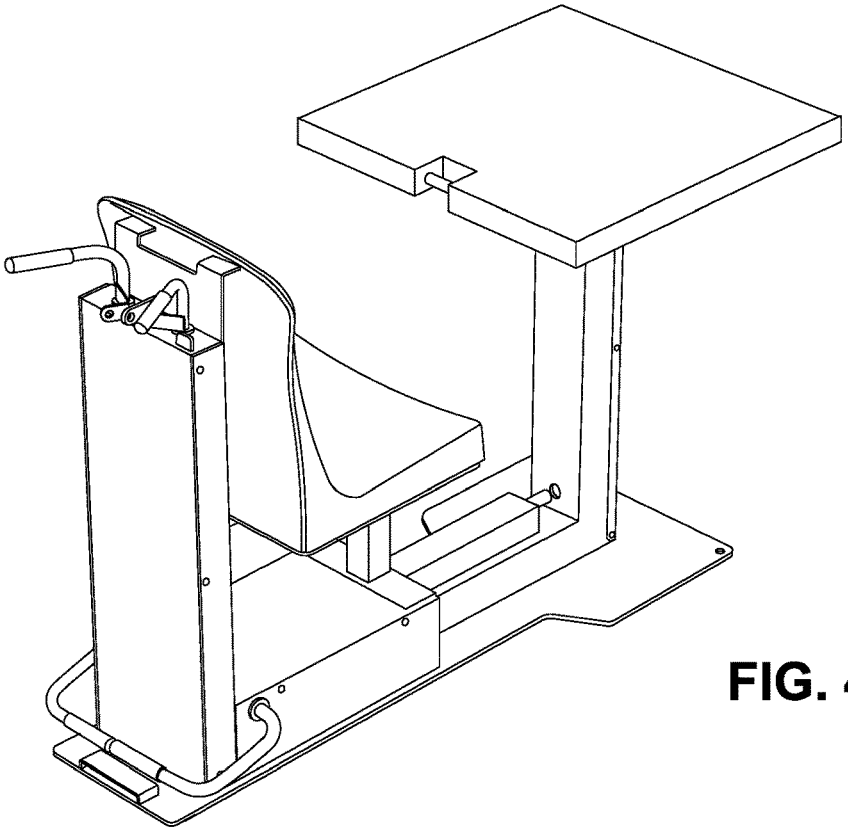
FIG. 4 shows an intermediate position during locking.

FIGS. 1-4 show rear perspective views of the therapeutic restraint chair 100 in various configurations. The restraint chair 100 includes a supporting frame 110, a seat 112 secured to a seat pedestal 114 fixed to the supporting frame 110, and a desk 116 secured to a desk pedestal 118 fixed to the supporting frame 110. A wrist capture bar 16 is associated with the desk 116 and is displaceable between a retracted position (as shown in FIG. 2) and an extended position (as shown in FIG. 1). The desk 116 is provided with a notch on 122 in a side thereof facing the seat 112. The wrist capture bar 120 spans across the notch 122 in the extended position.

An ankle capture bar 27 associated with the desk pedestal 118 is displaceable between a disengaged position (as shown in FIG. 1) and an engaged position (as shown in FIG. 2). A bar housing 126 is secured to the supporting frame 110. The ankle capture bar 122 may be disposed in the bar housing 126. In this context, the desk pedestal 118 may include a socket 128 (see FIG. 1) therein positioned facing the bar housing 126. The ankle capture bar 27 extends from the bar housing 126 into the socket 128 in the desk pedestal 118 in the engaged position.

Control levers 130, 132, 134, 136 are positioned behind the seat 112 for controlling positions of the wrist capture bar 16 and the ankle capture bar 27. Specifically, the chair includes a first hand-operated lever 130, a second hand-operated lever 132, a first foot-operated lever 134 and a second foot-operated lever 136. As described in more detail below, translation of the first hand-operated lever 132 and/or translation of the first foot-operated lever 134 effect displacement of the wrist capture bar 16. Additionally, translation of the second hand-operated lever 132 and/or translation of the second foot-operated lever 136 effect displacement of the ankle capture bar 27.

Figure 5:
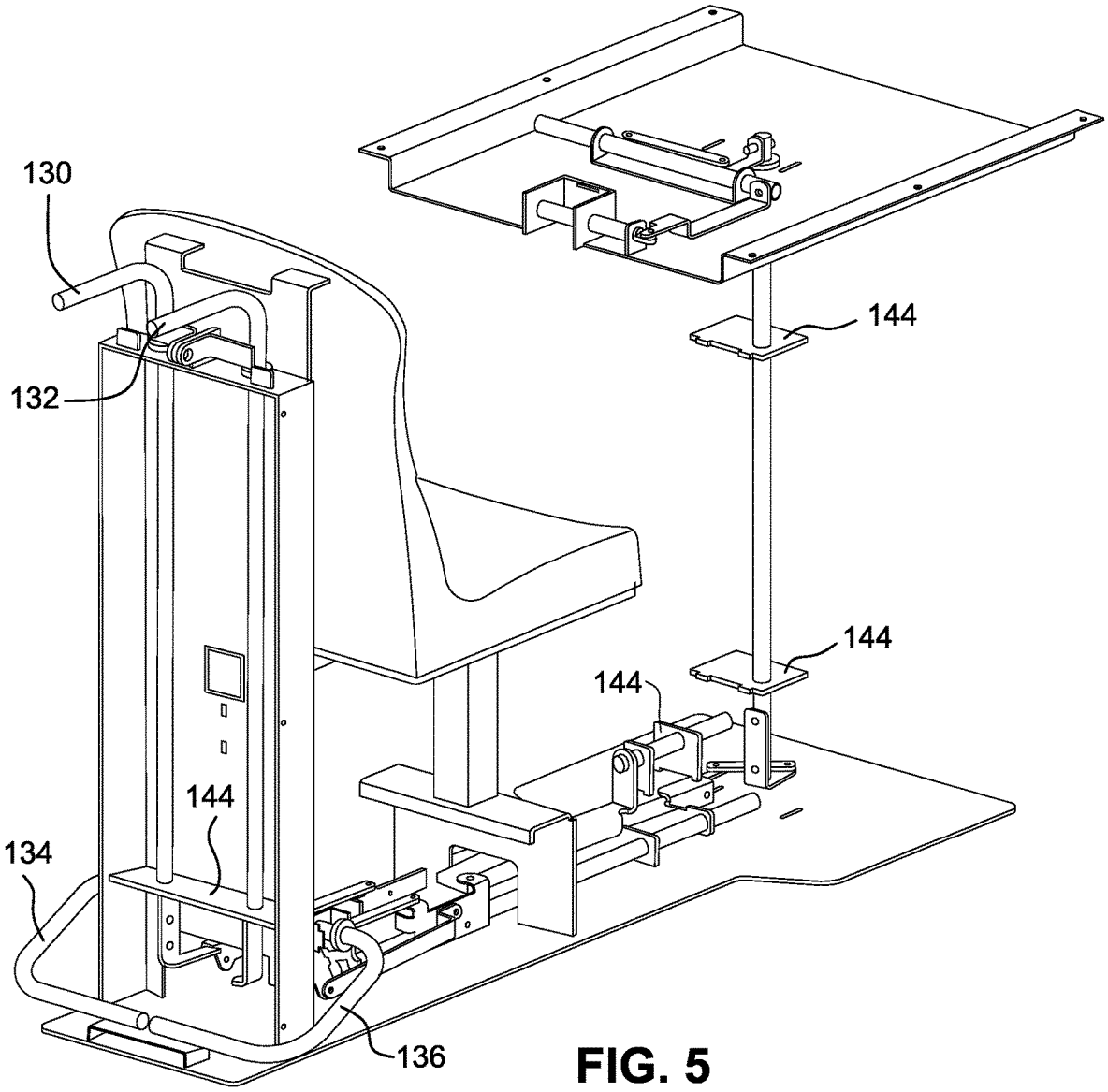
FIG. 5 is a rear perspective view showing internal components of the restraint chair.
Figure 8A:
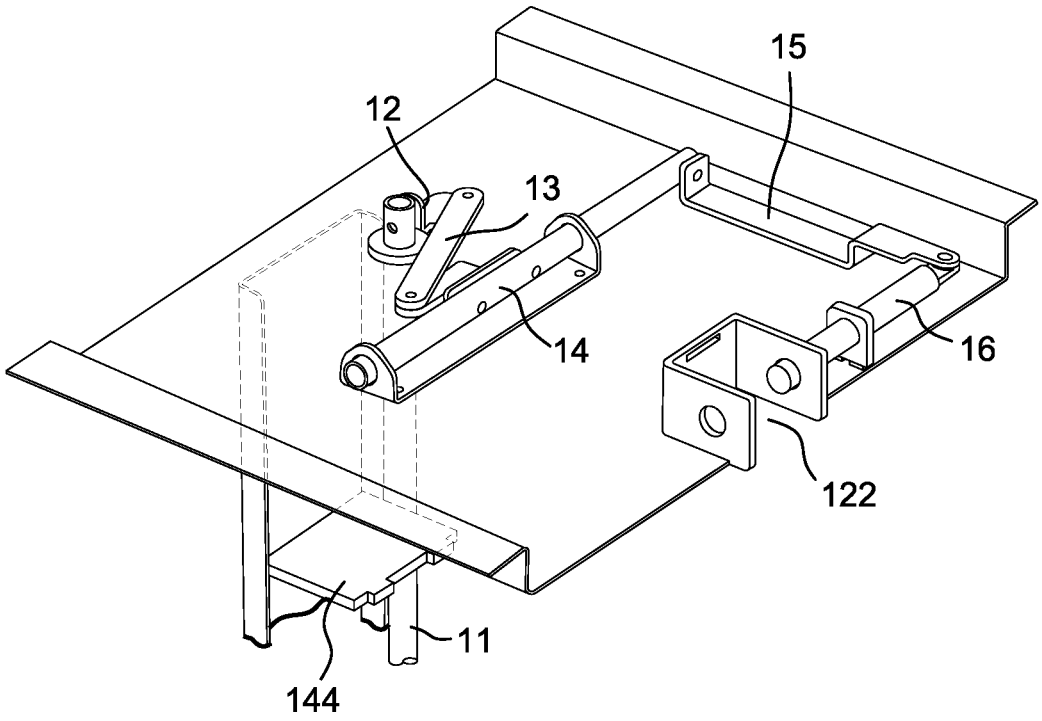
FIGS. 8A-8C show details of the mechanisms for operating the wrist capture bar.
Figure 8C:
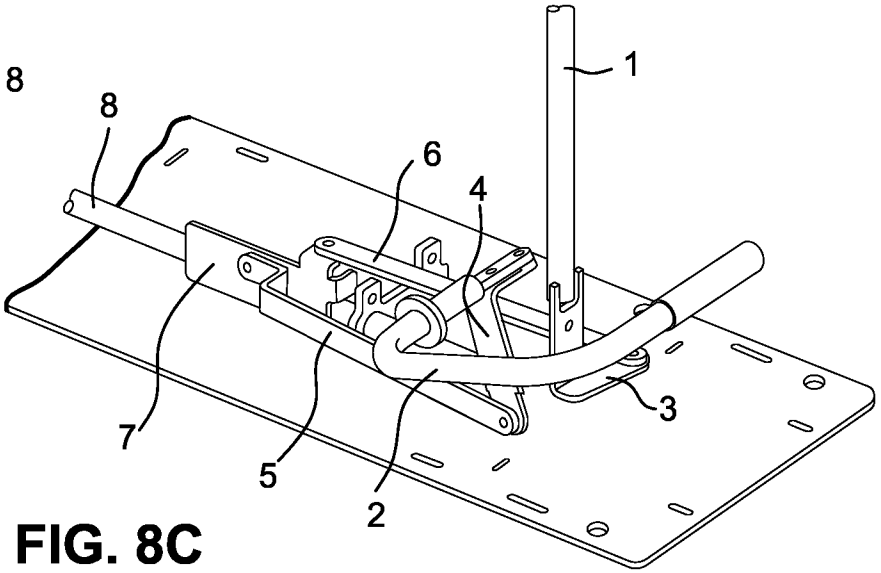
Figure 8B:
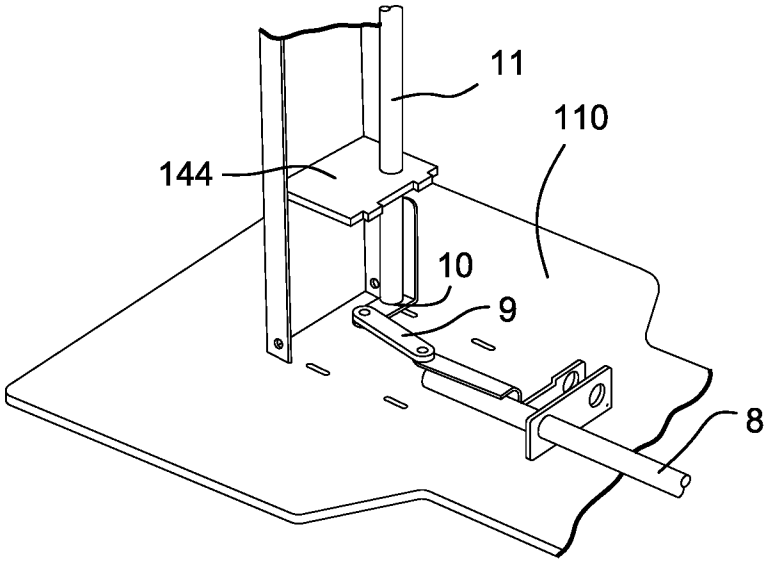

FIG. 5 is a rear perspective view showing the internal components of the restraint chair. Each of the control levers 130, 132, 134, 136 effects displacement of the wrist capture bar 16 or the ankle capture bar 27 via a respective link assembly. FIGS. 8A-8C show details of a wrist bar linkage assembly. As shown, the first hand-operated control lever 130 extends into or is connected to a hand-operated actuating shaft 1. A first hand-operated linkage cam 3 is connected to the first hand-operated lever 130 via the hand-operated actuating shaft 1. The first hand-operated linkage cam 3 is rotatable with rotation of the first hand-operated lever 130. A first hand-operated linkage 6 is connected at one end to the first hand-operated linkage cam 3. The connection point of the hand-operated linkage 6 to the hand-operated linkage cam 3 is offset from a rotation axis of the hand-operated linkage cam 3. As such, the first hand-operated linkage cam 3 converts rotation of the first hand-operated lever 130 into linear displacement of the first hand-operated linkage 6. An opposite end of the first hand-operated linkage 6 is connected to a wrist bar coupling 7.

The wrist bar linkage assembly further includes a first foot-operated linkage cam 4 connected to the first foot-operated lever 134 via a foot-operated actuating shaft 2. Displacement of the first foot-operated lever 134 effects rotation of the first foot-operated linkage cam 4. A first foot-operated linkage 5 is connected at one end to the first foot-operated linkage cam 4, offset from a pivot point of the foot-operated linkage cam 4. As such, the first foot-operated linkage cam 4 converts displacement of the first foot-operated lever 134 into linear displacement of the first foot-operated linkage 5. An opposite end of the first-operated linkage 5 is connected to the wrist bar coupling 7.

A horizontal linkage shaft 8 is connected to and is linearly displaceable with the wrist bar coupling 7. A vertical linkage 10 is rotatably secured to the supporting frame 110 on a rotating axis. The vertical linkage 10 is connected to the horizontal linkage shaft 8 offset from the rotating axis such that displacement of the horizontal linkage shaft 8 effects rotation of the vertical linkage 10. As shown in FIG. 8B, a vertical linkage cam 9 may be connected between the horizontal linkage shaft 8 and the vertical linkage 10. A vertical linkage shaft 11 is connected to and rotatable with the vertical linkage 10. With reference to FIG. 8A, a desk level linkage cam 12 is connected to and rotatable with the vertical linkage shaft 11, and a desk level coupling 13 is connected at one end to the desk level linkage cam 12. A desk level linkage shaft 14 is connected to an opposite end of the desk level coupling 13. The desk level coupling 13 converts rotation of the desk level linkage cam 12 into linear displacement of the desk level linkage shaft 14. The desk level linkage shaft 14 is connected to the wrist capture bar 16. As shown in FIG. 8A, a desk level linkage 15 may be connected between the desk level linkage shaft 14 and the wrist capture bar 16.

Figure 9:
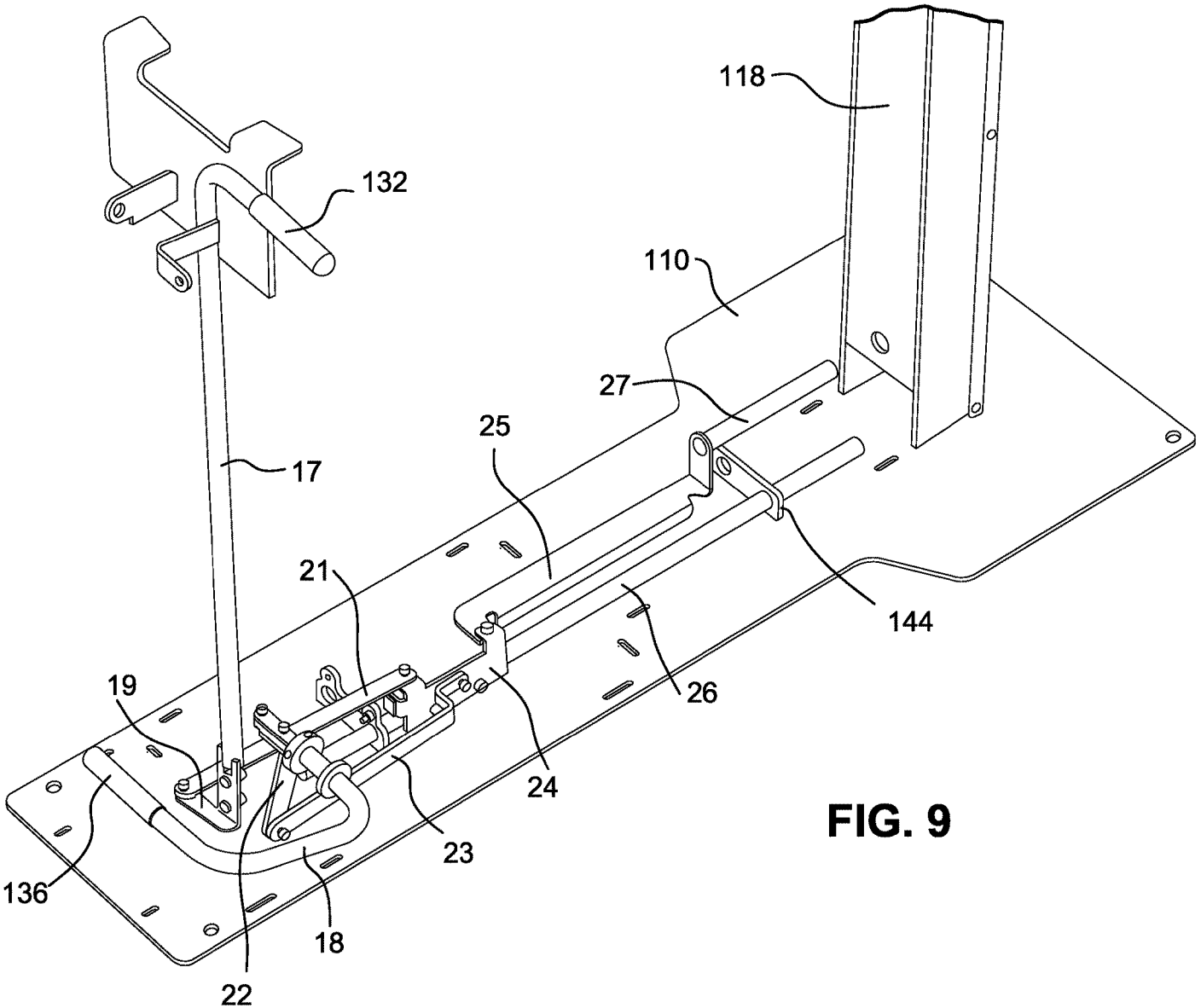
FIG. 9 shows details of the mechanisms for operating the ankle capture bar.

The linkage assembly also includes an ankle bar linkage. Details of the ankle bar linkage are shown in FIG. 9. As shown, the second hand-operated lever 132 is connected to or extends into a hand-operated actuating shaft 17. The hand-operated actuating shaft 17 is rotatable with rotation of the second hand-operated lever 132. A second hand-operated linkage cam 19 is connected to the hand-operated actuating shaft. The second hand-operated linkage cam 19 is rotatable with the hand-operated actuating shaft 17 on a rotating axis. A second hand-operated linkage 21 is connected at one end to the second hand-operated linkage cam 19 at a position spaced from the rotating axis. As such, the second hand-operated linkage cam 19 converts displacement of the second hand-operated lever 132 and the hand-operated actuating shaft 17 into linear displacement of the second hand-operated linkage 21. An opposite end of the hand-operated linkage 20 is connected to an ankle bar coupling 24.

A second foot-operated actuating shaft 18 is connected to or extends from the second foot-operated lever 136. The second foot-operated actuating shaft 18 is rotatable with displacement of the second foot-operated lever 136. A second foot-operated linkage cam 22 is connected at one end and is rotatable with the second foot-operated actuating shaft 18. A second foot-operated linkage 23 is connected to an opposite end of the second foot-operated linkage cam 22 spaced from a pivot axis of the second foot-operated linkage cam 22. As such, the second foot-operated linkage cam 22 converts rotation of the second foot-operated actuating shaft 18 into linear displacement of the second foot-operated linkage 23. The second foot-operated linkage 23 is connected at an opposite end to the ankle bar coupling 24. The ankle capture bar 27 is connected to the ankle bar coupling 24 and is linearly displaceable with the ankle bar coupling 24. As shown, the assembly may additionally include a supporting guide shaft 26 fixed to the supporting frame 110. The ankle bar coupling 24 may be supported by and displaceable on the supporting guide shaft 26.

The parts and components of the linkage assembly are housed within the desk pedestal 118, floor housings 138, 140, and an upright housing 142. Supporting brackets 144 may be secured in the desk pedestal 118 and housings 138, 140, 142 and/or fixed to the supporting frame 110 to provide support for the linkage assembly components. See, for example, FIGS. 5, 8A, 8B and 9.

Figure 6:
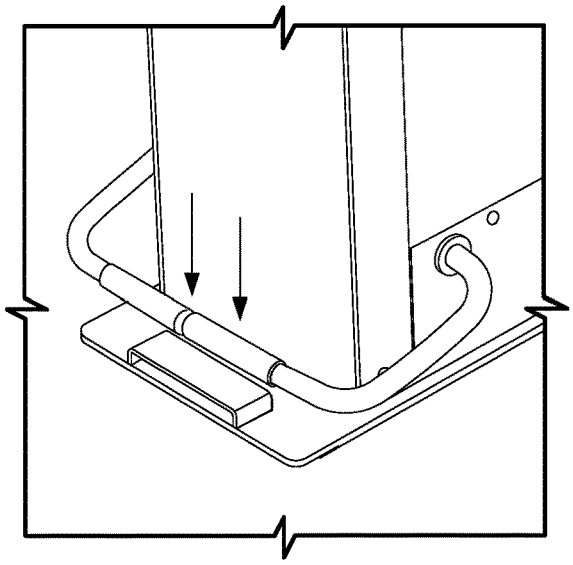
FIG. 6 shows both foot levers simultaneously pushed down to close both capture bars.

The control levers 130, 132, 134, 136 are translatable to effect simultaneous displacement of the wrist capture bar 16 and the ankle capture bar 27. As shown in FIG. 6, for example, the foot-operated levers 134, 136 are positioned in sufficient proximity such that both levers can be simultaneously activated to close both the wrist capture bar 16 and the ankle capture bar 27. The control levers 130, 132, 134, 136 are also translatable independently to effect independent displacement of the wrist capture bar 16 and the ankle capture bar 27.

Figure 7A:
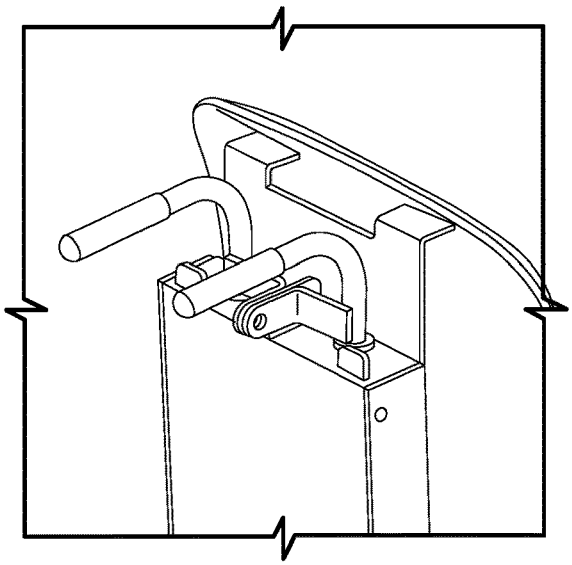
FIGS. 7A and 7B show mated hasps that enable locking in the closed position.
Figure 7B:
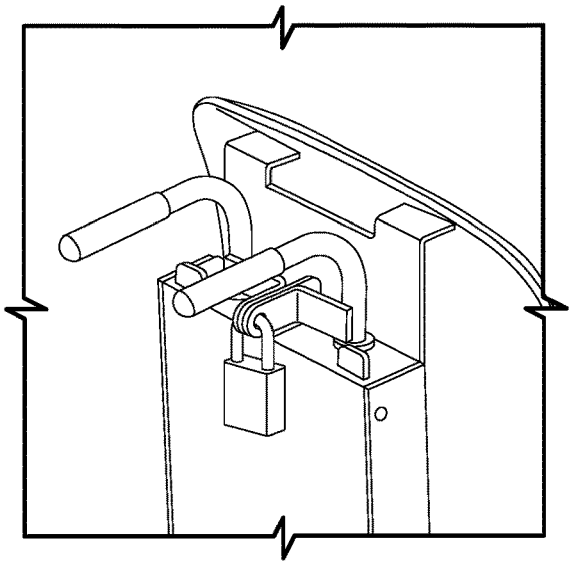

With reference to FIGS. 7A and 7B, the hand-operated control levers 130, 132 may be provided with hasps 146 or the like such that with the hand-operated control levers 130, 132 in a position in which the wrist capture bar 16 and the ankle capture bar 27 are in the extended position and the engaged position, respectively, the hand-operated control levers 130, 132 can be locked together.

In use, the client is directed to sit on the chair part of the assembly and fit his or her handcuff or ankle cuff chain into the recessed notch designed into either the front of the desktop or at the base of the desk pedestal. The securing rods are extended by staff personnel using hand or foot pedals from behind the client, across the recessed notch, trapping the chain within the notch. The two sets of handle gripped drive levers engage the securing rods (hand or foot), one set at floor level, operated by foot, and the other set at waist level, operated by hand. The handcuff trapping mechanism may be engaged by the set of handles (upper and lower) on the left side as the operator faces the back of the chair, and the ankle cuff trapping mechanism may be actuated by the handles on the right side of the assembly.

The restraint chair according to the described embodiments enables both capture bars to be engaged simultaneously or independently. Additionally, the use of hasps enables the control levers to be locked with the capture bars engaged.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A restraint chair comprising:

a supporting frame;

a seat secured to a seat pedestal fixed to the supporting frame;

a desk secured to a desk pedestal fixed to the supporting frame;

a wrist capture bar associated with the desk and displaceable between a retracted position and an extended position;

an ankle capture bar associated with the desk pedestal and displaceable between a disengaged position and an engaged position; and control levers positioned behind the seat that are coupled with the wrist capture bar and the ankle capture bar via a link assembly, wherein translation of the control levers effects respective displacement of the wrist capture bar between the retracted position and the extended position and of the ankle capture bar between the disengaged position and the engaged position wherein the control levers are translatable to effect simultaneous displacement of the wrist capture bar and the ankle capture bar.

2. A restraint chair according to claim 1, wherein the desk comprises a notch in a side thereof facing the seat, and wherein the wrist capture bar spans across the notch in the extended position.

3. A restraint chair according to claim 1, further comprising a bar housing secured to the supporting frame, wherein the ankle capture bar is disposed in the bar housing, the desk pedestal comprising a socket therein positioned facing the bar housing, wherein the ankle capture bar extends from the bar housing into the socket in the desk pedestal in the engaged position.

4. A restraint chair according to claim 1, comprising four control levers including a first hand-operated lever, a second hand-operated lever, a first foot-operated lever, and a second foot-operated lever, wherein translation of the first hand-operated lever and/or translation of the first foot-operated lever effect displacement of the wrist capture bar, and wherein translation of the second hand-operated lever and/or translation of the second foot-operated lever effect displacement of the ankle capture bar.

5. A restraint chair according to claim 4, wherein the first hand-operated lever and the second hand-operated lever comprise respective hasps that are configured for receiving a lock when the first hand-operated lever and the second hand-operated lever are positioned with the wrist capture bar in the extended position and with the ankle capture bar in the engaged position.

6. A restraint chair according to claim 4, wherein the linkage assembly comprises a wrist bar linkage assembly including:

a first hand-operated linkage cam connected to the first hand-operated lever, wherein the first hand-operated linkage cam is rotatable with rotation of the first hand-operated lever;

a first hand-operated linkage connected at one end to the first hand-operated linkage cam, wherein the first hand-operated linkage cam converts rotation of the first hand-operated lever and the first hand-operated linkage into linear displacement of the first hand-operated linkage;

a wrist bar coupling connected to an opposite end of the first hand-operated linkage;

a first foot-operated linkage cam connected to the first foot-operated lever, wherein displacement of the first foot-operated lever effects rotation of the first foot-operated linkage cam;

a first foot-operated linkage connected at one end to the first foot-operated linkage cam, wherein the first foot-operated linkage cam converts displacement of the first foot-operated lever and the first foot-operated linkage into linear displacement of the first foot-operated linkage, wherein an opposite end of the first foot-operated linkage is connected to the wrist bar coupling;

a horizontal linkage shaft connected to and linearly displaceable with the wrist bar coupling;

a vertical linkage rotatably secured to the supporting frame on a first rotating axis, the vertical linkage being connected to the horizontal linkage shaft offset from the first rotating axis such that displacement of the horizontal linkage shaft effects rotation of the vertical linkage;

a vertical linkage shaft connected to and rotatable with the vertical linkage;

a desk level linkage cam connected to and rotatable with the vertical linkage shaft;

a desk level coupling connected at one end to the desk level linkage cam; and a desk level linkage shaft connected to an opposite end of the desk level coupling, wherein the desk level coupling converts rotation of the desk level linkage cam into linear displacement of the desk level linkage shaft, wherein the desk level linkage shaft is connected to the wrist capture bar.

7. A restraint chair according to claim 6, wherein the wrist bar linkage assembly further comprises a vertical linkage cam connected between the horizontal linkage shaft and the vertical linkage.

8. A restraint chair according to claim 6, wherein the wrist bar linkage assembly further comprises a desk level linkage connected between the desk level linkage shaft and the wrist capture bar.

9. A restraint chair according to claim 4, wherein the linkage assembly comprises an ankle bar linkage assembly including:

a hand-operated actuating shaft connected to the second hand-operated lever, wherein the hand-operated actuating shaft is rotatable with rotation of the second hand-operated lever;

a second hand-operated linkage cam connected to the hand-operated actuating shaft, wherein the second hand-operated linkage cam is rotatable with the hand-operated actuating shaft on a second rotating axis;

a second hand-operated linkage connected at one end to the second hand-operated linkage cam at a position spaced from the second rotating axis, wherein the second hand-operated linkage cam converts displacement of the second hand-operated lever and the hand-operated actuating shaft into linear displacement of the second hand-operated linkage;

an ankle bar coupling connected to an opposite end of the second hand-operated linkage;

a second foot-operated actuating shaft connected to the second foot-operated lever, the second foot-operated actuating shaft being rotatable with displacement of the second foot-operated lever;

a second foot-operated linkage cam connected at one end to and being rotatable with the second foot-operated actuating shaft; and a second foot-operated linkage connected to an opposite end of the second foot-operated linkage cam, the second foot-operated linkage cam converting rotation of the second foot-operated actuating shaft into linear displacement of the second foot-operated linkage, wherein the second foot-operated linkage is connected to the ankle bar coupling, wherein the ankle capture bar is connected to the ankle bar coupling and is linearly displaceable with the ankle bar coupling.

10. A restraint chair according to claim 9, wherein the ankle bar linkage assembly further comprises a supporting guide shaft fixed to the supporting frame, and wherein the ankle bar coupling is supported by and displaceable on the supporting guide shaft.

11. A restraint chair comprising:

a supporting frame;

a seat secured to a seat pedestal fixed to the supporting frame;

a desk secured to a desk pedestal fixed to the supporting frame;

a wrist capture bar associated with the desk and displaceable between a retracted position and an extended position;

an ankle capture bar associated with the desk pedestal and displaceable between a disengaged position and an engaged position; and control levers positioned behind the seat that are coupled with the wrist capture bar and the ankle capture bar via a link assembly, wherein translation of the control levers effects respective displacement of the wrist capture bar between the retracted position and the extended position and of the ankle capture bar between the disengaged position and the engaged position, wherein the control levers are translatable independently to effect independent displacement of the wrist capture bar and the ankle capture bar.

12. A restraint chair comprising:

a supporting frame;

a seat secured to a seat pedestal fixed to the supporting frame;

a desk secured to a desk pedestal fixed to the supporting frame;

a wrist capture bar associated with the desk and displaceable between a retracted position and an extended position;

an ankle capture bar associated with the desk pedestal and displaceable between a disengaged position and an engaged position; and control levers positioned behind the seat that are coupled with the wrist capture bar and the ankle capture bar via a link assembly, wherein translation of the control levers effects respective displacement of the wrist capture bar between the retracted position and the extended position and of the ankle capture bar between the disengaged position and the engaged position, wherein the control levers are configured to be locked with the wrist capture bar in the extended position and with the ankle capture bar in the engaged position.

13. A restraint chair according to claim 12, wherein at least two of the control levers comprise hasps.

14. A restraint chair comprising:

a supporting frame;

a seat secured to a seat pedestal fixed to the supporting frame;

a desk secured to a desk pedestal fixed to the supporting frame;

a wrist capture bar associated with the desk and displaceable between a retracted position and an extended position;

an ankle capture bar associated with the desk pedestal and displaceable between a disengaged position and an engaged position; and four control levers positioned behind the seat, wherein a first two of the four control levers are coupled with the wrist capture bar via a wrist bar linkage assembly, and a second two of the four control levers are coupled with the ankle capture bar via an ankle bar linkage assembly, wherein displacement of either or both of the first two control levers effects displacement of the wrist capture bar, and wherein displacement of either of both of the second two control levers effects displacement of the ankle capture bar.

15. A restraint chair according to claim 14, wherein the first two control levers comprise a first hand-operated lever and a first foot-operated lever, and wherein the second two control levers comprise a second hand-operated lever and a second foot-operated lever.

16. A restraint chair according to claim 15, wherein the first hand-operated lever and the second hand-operated lever each comprise hasps that are lockable with the wrist capture bar in the extended position and with the ankle capture bar in the engaged position.

17. A restraint chair according to claim 14, wherein the four control levers are translatable to effect simultaneous displacement of the wrist capture bar and the ankle capture bar.

* * * * *